United States Patent [19]

DeCicco

[11] Patent Number: 4,991,246

[45] Date of Patent: Feb. 12, 1991

[54] PINE NEEDLE CUTTER

[75] Inventor: Julius J. DeCicco, Spring Hill, Fla.

[73] Assignee: The Julius J. DeCicco Trust, Spring Hill, Fla.

[21] Appl. No.: 504,886

[22] Filed: Apr. 5, 1990

[51] Int. Cl.[5] ..... B25F 1/00

[52] U.S. Cl. ..... 7/158; 15/105; D4/118

[58] Field of Search ..... 7/158, 170; 15/105, 15/111; D4/118

[56] References Cited

U.S. PATENT DOCUMENTS

| | | | |
|---|---|---|---|
| D. 235,119 | 5/1975 | Gode | D4/118 |
| D. 257,521 | 11/1980 | Piero | D4/118 |
| 1,760,268 | 5/1930 | Cave | 15/111 |
| 2,689,967 | 9/1954 | Mackey | 15/111 |
| 3,084,369 | 4/1963 | Hawkins | 15/111 |
| 3,094,728 | 6/1963 | White | D4/118 |
| 3,097,384 | 7/1963 | Clark | 15/111 |
| 3,307,212 | 3/1967 | MacInnis | 15/111 |
| 4,785,489 | 11/1988 | Von Doehren | 15/111 |

FOREIGN PATENT DOCUMENTS

| | | | |
|---|---|---|---|
| 109101 | 2/1925 | Switzerland | 15/111 |

*Primary Examiner*—Roscoe V. Parker

*Attorney, Agent, or Firm*—Pettis & McDonald

[57] ABSTRACT

A pine needle cutting apparatus for removal of pine needles trapped in screening, comprising a tool head having a removably attached cutting blade, brush, and handle connector to which a handle may be removably fastened. The cutting blade has opposing ends, a front portion, a rear portion, two arcuate portions, and a circumferential edge that defines the perimeter of the blade. The acruate portions of the front portion of the blade are adjacent each end. The circumferential edge along the front portion of the cutting blade between the arcuate portions has a cutting edge formed thereon and the remaining portions of the circumferential edge are dull. The circumferential edge along the front portion of the cutting blade is curved at a predetermined radius. The circumferential edge of each arcuate portion has a predetermined radius which is different from the predetermined radius of the front portion.

9 Claims, 2 Drawing Sheets

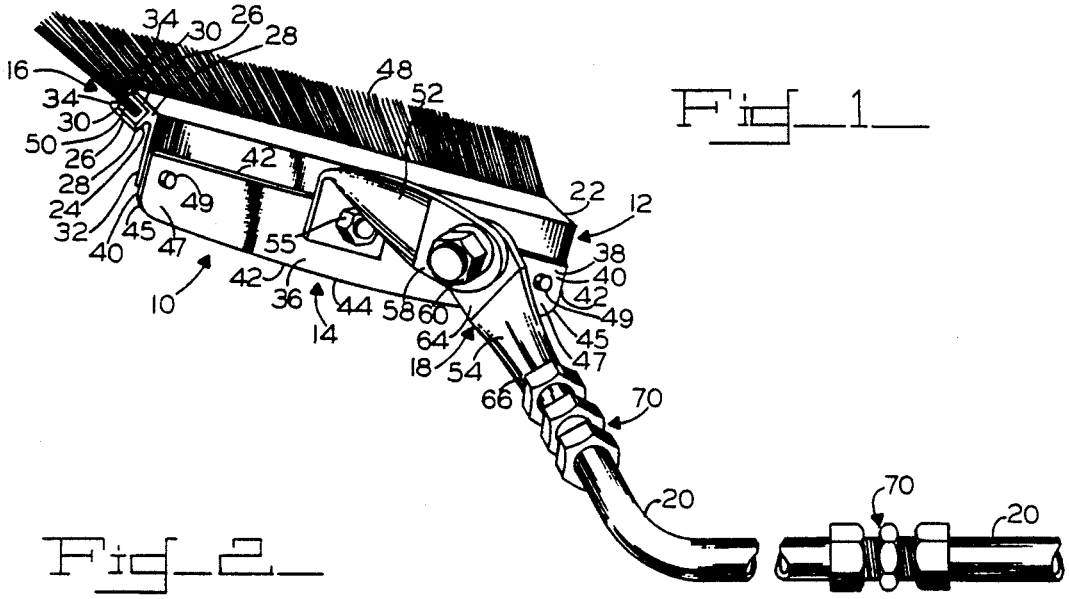
Fig. 1
Fig. 2
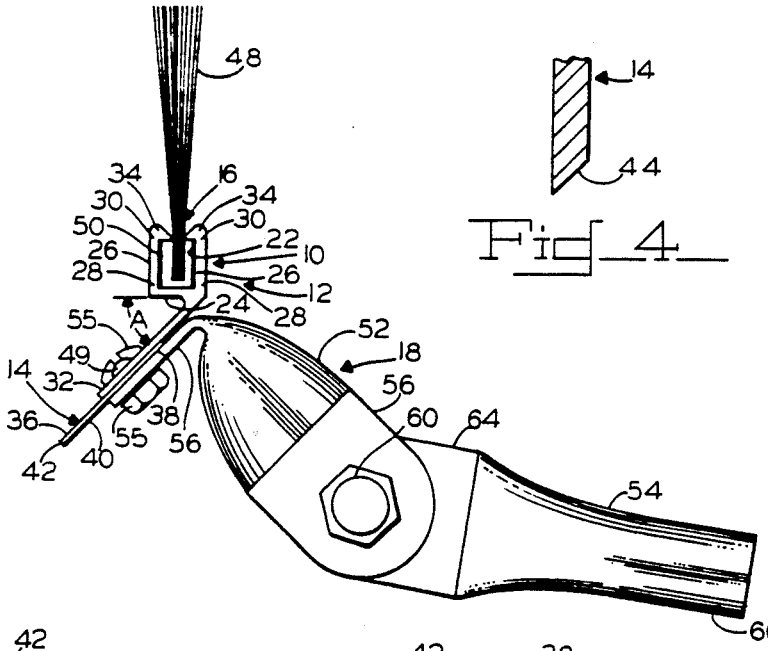
Fig. 4
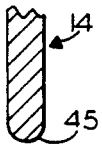
Fig. 5
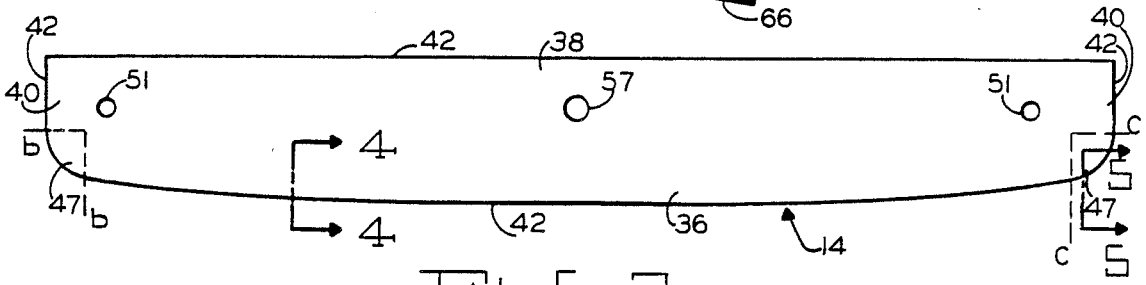
Fig. 3

PINE NEEDLE CUTTER

BACKGROUND OF THE INVENTION

1. Field of the Invention

The present invention relates to a pine needle cutter whereby one person may easily remove pine needles that are trapped within screening. A plurality of pine needles are frequently joined together at one end by a pine needle head. When the joined pine needles fall upon a screen surface, the individual pine needles often drop into separate holes in the screening; the pine needles are then captured by the screening, as the pine needle heads prevent the needles from falling all the way through. The pine needle cutting apparatus cuts the pine needle heads from the pine needles, releasing the pine needles so they may fall the rest of the way through the screen. The pine needle heads may then be swept from the screening using the brush portion of the pine needle cutter.

2. Description of the Prior Art

In many areas of the country, it is necessary to screen outdoor areas to prevent the intrusion of insects and debris. One particular problem occurs when the screening is located adjacent to pine trees which shed their needles in a form that a plurality of needles are joined together at one end by a pine needle head. Frequently, when the joined pine needles fall upon screening, the free ends of the joined needles drop through the holes in the screen but are prevented from passing through the screen by the pine needle head. Eventually, as the numbers of pine needles that are trapped within the screening increase, the air flow and the light passing through the screen are reduced and the appearance of the screening becomes very unattractive. Sweeping with a brush or using a blower has not been a successful means for removing those pine needles that are trapped within the screening. Currently, there is no device that is specifically designed to solve this problem. The prior art consists primarily of combinations of brushes and scrapers which are used to remove debris from floors.

One such device is disclosed in U. S. Design Pat. No. 235,119 to Delbert R. Gode. The device teaches a combination floor brush, scraper and a wiper. The design of the scraper is unclear.

Another such device is disclosed by U.S. Pat. No. 3,094,728 issued to Oscar F. White that also discloses a broom with an attached scraper. The scraper is narrow with pointed corners and has a straight edge.

U.S. Pat. No. 3,097,384 issued to John V. Clark discloses a broom and scraper combination which has a protective shield that covers the scraper until the scraper is needed. The scraper has a straight edge and is fixed in relation to the handle and the brush.

U.S. Design Pat. No. 257,521 issued to Niccolai Piero is a hand held scraper and brush combination which discloses a straight edge scraper fixedly attached to a short handle and a brush.

A number of other hand held tools have been designed to solve particular problems; one of these devices is a grill cleaning tool disclosed by U.S. Pat. No. 3,487,491 and issued to John M. Dunn. This hand held tool is a combination brush, wire scraper, and flat bladed scraper which is slidably extended along the shaft of the hand held tool. The blade is a narrow blade having a curvature which has been designed to fit the curve of the brazier or grill bottom.

Another specialty brush scraper combination is disclosed by U.S. Design Pat. No. 232,299 which was issued to Maurice Epstein which discloses an ice scraper and brush apparently designed for removing snow and ice from automobile windshields.

A number of hand held cutting tools have been specially designed for specific purposes. For example, U.S. Pat. No. 2,646,621 issued to Paul Catanese discloses a thorn removing device having a fixed double edge blade designed with a "V" so that the blade may be drawn along a rose stem removing the rose's thorns. Another specialty item is disclosed by U.S. Pat. No. 4,805,307 issued to George A. Lucas, Jr., et al. which discloses a small hand held device having a straight edged blade that is attached to a holder that is used to thin clusters of grapes so that the remaining grapes will grow larger.

None of the prior art discloses or suggests an apparatus which could be used successfully to remove pine needles trapped within screening. Therefore, it remains clear that there is a need for a device that can remove pine needles with little risk of damage to the screening.

SUMMARY OF THE INVENTION

The present invention relates to a pine needle cutter, an apparatus for removing pine needles that have been trapped in screening. A plurality of pine needles are often joined at one of their ends by a pine needle head. When pine needles fall on screening, the free ends of the pine needles often fall through the screening holes; however, the pine needle heads, being larger than the screen, prevent the pine needles from passing all the way through the screening. The pine needle cutter is used to remove the pine needle heads from the needles so that the needles may fall the rest of the way through the screening, and then the apparatus is used to sweep the pine needle heads and any other debris from the screening surface. Most simply stated, the pine needle cutter of this invention comprises a tool head, a cutting blade removably attached to the tool head, a brush that is removably attached to the tool head and a handle connecting means which may pivotally join the tool head to a handle.

The tool head is a U-shaped channel to which a blade attaching plate has been contiguously and angularly joined to the base of the channel. The brush head is so configured and sized that it may be removably mounted to the tool head by sliding the head into the U-shaped channel. The cutting blade has opposed ends, a front portion, a rear portion, arcuate portions and a circumferential edge. The rear portion of the blade is removably attached to the blade attaching plate of the too head. The circumferential edge defines the perimeter of the cutting blade. The circumferential edge of the front portion of the blade is shaped to a predetermined radius and has a cutting edge formed thereon. The arcuate portions of the cutting blade are interposed between each end of the cutting blade and the front portion of the cutting blade. The circumferential edges of the arcutate portions of the cutting blade are curved to a predetermined radius and the circumferential edges of these portions are dull as they do not have a cutting surface formed thereon.

A sectional handle is connected to the tool head so that persons may extend the handle to reach screens above and/or beyond their reach, for example, the tops of screen enclosures over swimming pools and patios. Since the screening material of such enclosures is frequently sloped at different angles, a handle connecting means is interposed between the handle and the tool head. The handle connecting means has a pivoting joint intermediate each end of the connecting means. This pivoting joint permits the angular adjustment of the cutting blade or the brush to ensure the cutting blade or brush may be placed in contact with the screening.

The invention accordingly comprises an article of manufacture possessing the features, properties, and the relation of the elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed descriptions taken in connection with the accompanying drawings, in which:

FIG. 1 is an isometric view of the preferred embodiment of the pine needle cutter.

FIG. 2 is a left side elevation of the preferred embodiment of the pine needle cutter.

FIG. 3 is a plan view of the preferred embodiment of the cutting blade detached from the pine needle cutter.

FIG. 4 is a cross-section of the cutting blade taken along line 4—4 of FIG. 3 illustrating the cutting edge of the blade.

FIG. 5 is a cross-section of the cutting blade taken along line 4—4 of FIG. 3 illustrating the rounded edge of the cutting blade.

Similar reference characters refer to similar parts throughout the several views of the drawings.

DESCRIPTION OF THE PREFERRED EMBODIMENT

Figure 6:
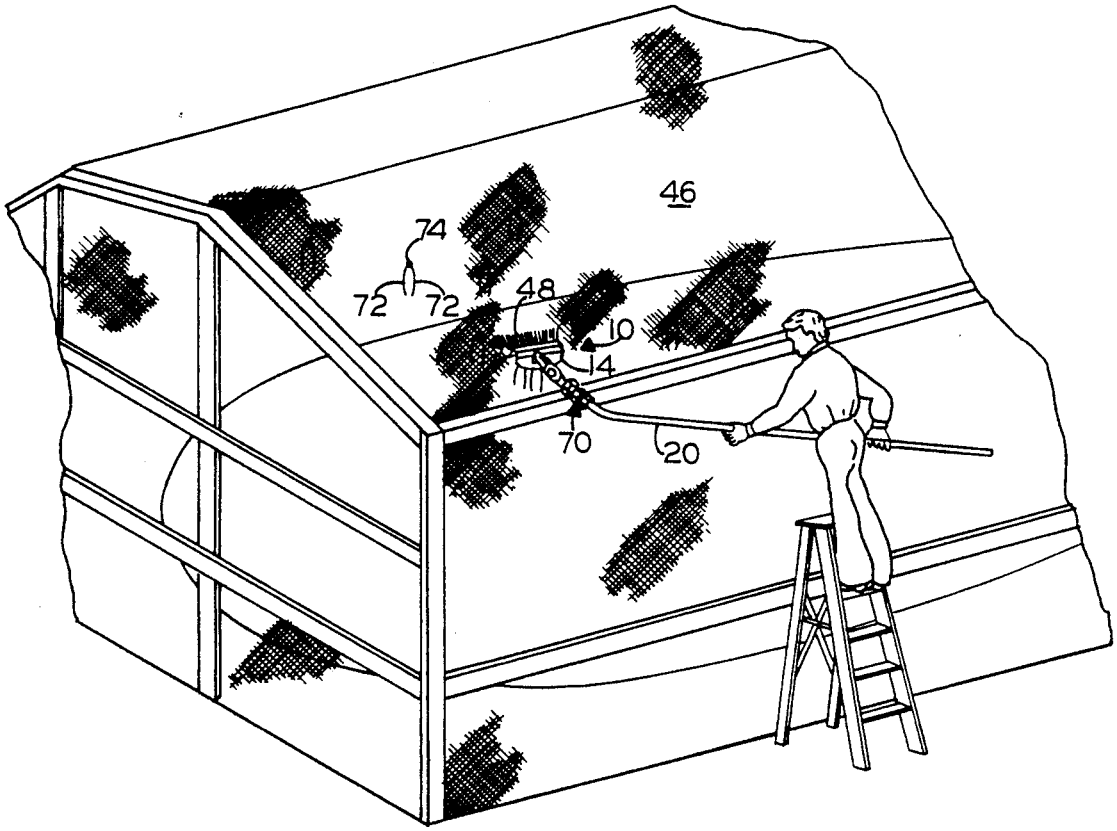
FIG. 6 is a perspective view illustrating the pine needle cutter being used to remove pine needles from a swimming pool enclosure.

A preferred embodiment for the pine needle cutter is illustrated in the drawing figures. The pine needle cutter is generally indicated as 10 in the views of FIGS. 1, 2 and 6. Referring first to the view of FIG. 1, it can be seen that the pine needle cutter 10 comprises a tool head generally indicated as 12, a cutting blade 14, a brush shown generally as 16, a handle connecting means generally indicated as 18 and a sectional handle 20.

In FIG. 1 and FIG. 2, the tool head 12 can further be seen to comprise a U-shaped channel 22 having a base 24 and two legs 26, each leg 26 having a first end 28 and a second end 30. The first ends 28 of the legs 26 are contiguously joined to the base 24, such that the legs 26 are substantially parallel to one another and substantially perpendicular to the base 24. A blade attaching plate 32 is contiguously joined to the base 24 at a predetermined angle A. In the preferred embodiment, angle A is generally 45°; however, angle A may range from 0° to 90°. An inwardly directed flange 34 is contiguously joined to each of the second ends 30 of the legs 26 of the U-shaped channel 22. Each flange 34 is formed substantially perpendicular to the legs 26 to which each flange 34 is attached.

The cutting blade 14 is shown detached from the tool head 12 in FIG. 3 and attached to the tool head 12 in FIGS. 1 and 2. The cutting blade 14 has a front portion 36, a rear portion 38, arcuate portions 47, a circumferential edge 42 and opposed ends 40. The circumferential edge 42 defines the perimeter of cutting blade 14. The circumferential edge 42, between the arcuate portions 47 of the front portion 36 of the blade 14, is curved to a predetermined radius. In the preferred embodiment, for a cutting blade 14 that is 8 inches long, this radius is about 42 inches; however, for an 8 inch cutting blade 14, the radius may lie between about 32 inches and 52 inches. The length of the cutting blade 14 is simply a matter of choice; however, as the length of the cutting blade is increased or decreased, the radius of the curvature of the circumferential edge 42 of the front portion 36 of the cutting blade 14 would be increased or decreased generally proportionally. The arcuate portions 47 of the front portion 36 of the blade 14, and shown generally in FIG. 3 as areas enclosed within lines b—b and lines c—c. The circumferential edge 42 of the arcuate portion 47 is curved to a $\frac{3}{8}$ inch radius in the preferred embodiment; however, as a matter of choice, the curvature may lie between about $\frac{1}{4}$ of an inch to $\frac{1}{2}$ an inch. A cutting edge 44 is formed on the circumferential edge 42, between the arcuate portions 47 of the front portion 36 of the cutting blade 14, as shown by section 4—4. The circumferential edge 42 of the arcuate portions 47 of the cutting blade 14 has a cross-section, as shown in section 5—5, which is dull to reduce the risk of damage to the screening 46. The cutting blade 14 as shown in FIGS. 1 and 2, is removably attached to the blade attaching plate 32 by pop rivets 49, which are inserted through blade connecting holes 51 of the cutting blade 14 and the related blade connecting holes, not shown, of the blade attaching plate 32. The preferred embodiment utilizes pop rivets 49 to attach the blade 14 to the blade attaching plate 32; however, nuts and bolts or other means well known in the art may be used to permit even easier removal of the blade 14.

The tool head in the preferred embodiment is manufactured from extruded aluminum and the blade is tempered blue steel with a thickness of 0.020 inches; however, both the tool holder and the blade may be made from any suitable material and to any suitable size. In addition, while not shown in the preferred embodiment, the rear portion 38 of the cutting blade 14 may be configured similar to the front portion 36, i.e. the rear portion 38 having that portion of the circumferential edge 42 curved to a predetermined radius and having a cutting edge formed thereon. Also, rear arcuate portions, similar to arcuate portions 47 may be added to the rear portion 38 adjacent each end 40. Such a configuration will provide an alternate cutting edge accessible by removing the blade 14 from the blade attaching plate 32 and either rotating or flipping the blade 14 so that the rear portion 38 is placed in the cutting position now occupied by the front portion 36, as shown in FIGS. 1 and 2.

Brush bristles 48 are inserted into a brush head 50 by any conventional means well known in the art; the brush head 50 is sized and configured to be slidably mounted within the U-shaped channel 22 of the tool head 12. In the preferred embodiment, the brush bristles 48 are made from nylon fibers with a 0.020 inch diameter and the bristles 48 extend about $1\frac{1}{2}$ inches from the brush head 50; however, the bristles 48 may be any suitable size or of any suitable material.

The handle connecting means 18 is comprised of a first tubular member 52 and a second tubular member 54. Member 52 has a first end 56 and a second end 58; the first end 56 of member 52 is flattened and has a hole, not shown, therethrough, while the second end 58 of member 52 is also flattened but at a substantially right angle to the plane of the flattened portion of the first end 56. The flattened portion of the second end 58 also has a hole, not shown, therethrough. The first end 56 of member 52 is attached by a nut and bolt 55, or by any other conventional means, to the tool head 12. When the nut and bolt 55 is used, the bolt is passed through a hole, not shown, through the blade attaching plate 32 through hole 57 of the cutting blade 14 and through the hole, not shown, in the first end 56 of member 52, and then the nut and bolt 55 are threaded together. The second member 54 of the handle connecting means 18 has a first end 64 and a second end 66. The first end 64 of the second member 54 has been flattened and has a hole, not shown, therethrough, whereby the first end 64 of member 54 may be pivotally attached to the second end 58 of the first member 52 by a nut and bolt 60 or by a bolt with a wing nut or any other suitable means to permit adjustment in the angle between the first member 52 and the second member 54 of the handle connecting means 18.

In the preferred embodiment, and as shown in FIG. 1, the second end 66 of member 54 is attached to a section of a sectional handle 20 by a standard coupler shown generally as 70. The handle 20 as shown in FIG. 1 and FIG. 6 is thin walled galvanized steel tubing, but the handle 20 may be constructed of aluminum, plastic or any other material generally used for extension handles. In the preferred embodiment, a sectional handle 20 is shown joined by handle connectors 70, that are standard couplers; however, any style extension handle may be used, for example a folding or telescoping handle, along with the appropriate style connectors that are well known in the art.

Having thus set forth a preferred construction for the pine needle cutter 10 of this invention, it is to be remembered that this is but a preferred embodiment. Attention is now invited to a description of the use of the pine needle cutter 10.

The pine needle cutter 10 is assembled with the handle connecting means 18 pivoted so that the cutting blade 14 may be rested on the screening 46 that is to be cleaned. As shown in FIG. 6, the person operating the pine needle cutter 10 then drags the cutting blade 14 across the screening 46 by pulling the pine needle cutter 10 toward himself. As the cutting blade 14 is drawn across the screening surface 46, the weight of the pine needle cutter 10 causes the screening to sink inward conforming generally to the curvature of the front portion 36 of the cutting blade 14. The circumferential edge 42 of the arcuate portion 47 of the cutting blade 14 has a dull edge 45, as seen in FIG. 5, rather than a cutting edge 44, which reduces the risk of the cutting blade 14 damaging the screening 46. As the blade moves across the screening, it encounters the pine needles 72 caught in the screening 46; the sharp cutting edge 44 cuts off the pine needle heads 74 permitting the needles 72 to fall through the screening and freeing the pine needle heads 74.

After the heads 74 have been removed from the pine needles 72, the pine needle cutter 10 is readjusted so that the brush 16 may be placed against the screening 46. The brush 16 is used to remove the pine needle heads 74 and any other debris which may have been caught on the screening.

It will thus be seen that the objects set forth above, among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, What is claimed is:

1. A pine needle cutting apparatus comprising:
a tool head;
a cutting blade attached to said tool head, said cutting blade having opposing ends, a front portion, a rear portion, and a circumferential edge; said front portion of said blade having an arcuate portion adjacent each said end of said cutting blade, said circumferential edge defining the perimeter of said cutting blade; said circumferential edge of said front portion of said cutting blade, between said arcuate portions, being curved to a predetermined radius, and having a cutting edge formed thereon; and said circumferential edge of said arcuate portions having a radius between about $\frac{1}{4}$ inch and about $\frac{1}{2}$ inch and having a dull edge formed thereon;
a brush means attached to said tool head;
a handle connected to said tool head; and
a handle connecting means interposed between said tool head and said handle.

2. A pine needle cutting apparatus as in claim 1 wherein said tool head further comprises:
a "U" shaped channel having a base, two legs, each said leg having a first end and a second end, said first ends contiguously joined to said base such that said legs are substantially parallel to one another, and an inwardly directed flange formed on each said second end of said legs of said channel; and
a blade attaching plate contiguously and angularly joined to said base of said channel.

3. A pine needle cutting apparatus as in claim 2 wherein said blade attaching plate is contiguously joined to said base of said channel at an angle of between about 30° and about 45°, and said rear portion of said cutting blade is removably attached to said blade attaching plate.

4. A pine needle cutting apparatus as in claim 2 wherein said brush means comprises a brush head having bristles attached thereon, said brush head so sized and configured that said brush head may be slidably inserted within said channel of said tool head.

5. A pine needle cutting apparatus as in claim 1 wherein said predetermined radius of said front portion of said cutting blade comprises a radius between about 32 inches and about 52 inches.

6. A pine needle cutting apparatus as in claim 1 wherein said handle further comprises a plurality of handle sections, and a plurality of handle connectors interposed between said handle sections.

7. A pine needle cutting apparatus as in claim 1 wherein said handle connecting means comprises an elongate member having two ends and a pivoting joint intermediate said ends, one of said ends being removably attached to said tool head and said other end being removably attached to said handle means.

8. A pine needle cutting apparatus comprising:
a tool head comprising a "U" shaped channel, said channel having a base and two legs; each said leg having a first end and a second end, said first ends contiguously joined to said base such that said legs are substantially parallel to one another and substantially at right angles to said base, and an inwardly directed flange contiguously joined to each said second end of said legs of said channel; and a blade attaching plate contiguously and angularly joined to said base of said channel at an angle between about 30° and about 45°;

a cutting blade removably attached to said tool head, said cutting blade having opposing ends, a front portion, a rear portion, and a circumferential edge; said front portion of said blade having an arcuate portion adjacent each said end of said cutting blade, said circumferential edge defining the perimeter of said cutting blade; said circumferential edge of said front portion of said cutting blade between said arcuate portions being curved to a radius of between about 32 inches and 52 inches, and having a cutting edge formed thereon; and said circumferential edge of said arcuate portions having a radius between about ¼ inch and about ½ inch, and said circumferential edge of said arcuate portions being dull;

a brush means removably attached to said tool head comprising a brush head having bristles attached thereon, said brush head so sized and configured that said brush head may be slidably inserted within said channel of said tool head;

a handle connecting means comprising a tube having two ends and a pivoting joint intermediate said ends, one said end removably attached to said tool head and said other end removably attached to said handle means; and a handle comprising a plurality of sections, each said section joined to another by a connector interposed therebetween, leaving a first end and a second end of said handle free, said first free end being connected to said handle connecting means and said second free end remaining free.

9. A method for removing pine needles from screening, the pine needles having been joined together at one end of each needle by a pine needle head, by utilizing a pine needle cutting apparatus having a tool head, a cutting blade, a brush means, pivoting handle connecting means, and handle sections joined by handle connectors, comprising the steps of:

a. positioning said pine needle cutting apparatus such that said blade of said tool head of said apparatus may be placed against the screening material to engage said pine needle heads;

b. pulling on said handle so that said blade is dragged across said screening such that blade of said pine needle cutter cuts said pine needle heads from said joined pine needles, such that said pine needles may drop through the screening;

c. repositioning said tool head so that said brush may rest against the screening material; and d. pulling said handle such that said brush is dragged across the screening to sweep the pine needle heads from the screening.

* * * * *